US009358593B1

(12) United States Patent
Hopper

(10) Patent No.: US 9,358,593 B1
(45) Date of Patent: Jun. 7, 2016

(54) TUBE BENDER

(71) Applicant: Colin William Hopper, Romoland, CA (US)

(72) Inventor: Colin William Hopper, Romoland, CA (US)

( * ) Notice: Subject to any disclaimer, the term of this patent is extended or adjusted under 35 U.S.C. 154(b) by 377 days.

(21) Appl. No.: 14/016,048

(22) Filed: Aug. 31, 2013

(51) Int. Cl.
*B21D 7/08* (2006.01)
*B21B 17/00* (2006.01)
*B21D 7/022* (2006.01)

(52) U.S. Cl.
CPC ..... *B21B 17/00* (2013.01); *B21D 7/022* (2013.01); *B21D 7/08* (2013.01)

(58) Field of Classification Search
CPC ..... B21D 3/10; B21D 7/00; B21D 7/02; B21D 7/022; B21D 7/024; B21D 7/06; B21D 7/08; B21B 17/00
See application file for complete search history.

(56) References Cited

U.S. PATENT DOCUMENTS 818,932 A * 4/1906 Baxter ..... B21D 7/06 72/213
3,499,309 A * 3/1970 Gregg ..... B21D 7/06 72/389.1
3,908,425 A * 9/1975 Ware ..... B21D 7/06 72/217
4,546,632 A * 10/1985 Van Den Kieboom ..... B21D 7/022 492/1
5,724,852 A * 3/1998 Lee ..... B21D 7/06 72/213
6,604,396 B2 * 8/2003 Kobayashi ..... B21F 33/002 29/890.03
2008/0190164 A1 * 8/2008 Boon ..... B23B 47/00 72/217
2010/0011832 A1 * 1/2010 Mizumura ..... B21D 7/066 72/369

FOREIGN PATENT DOCUMENTS

CH 580995 A5 * 10/1976 ..... B21D 7/06

OTHER PUBLICATIONS

Printout of the home page from the website of Hawke Industries (www.hawkeindustries.com), along with a page showing the Model Y2K Tube Roller—(printed out Jul. 28, 2013).
Advertisement for a 400-pound Electric Rolling Machine appearing on p. 82 of the Apr. 2001 issue of "The Fabricator" magazine; published by FMA Communications, Inc.

* cited by examiner

*Primary Examiner* — Edward Tolan
(74) *Attorney, Agent, or Firm* — Loyal McKinley Hanson

(57) ABSTRACT

An electrically powered apparatus for bending a length of stock includes a portable tube-bending component having a framework with two spaced-apart frame members and three rollers mounted rotatably on parallel horizontally disposed axles so that they occupy positions intermediate the two frame members. A first roller feeds stock longitudinally between the two frame members as it applies force downwardly on the length of stock, while the second and third rollers bear upwardly to produce the desired bending action. A power unit is provided on the framework in the form of a motor-and-reduction-gear assembly (MARG assembly) combined with a rotational-power-coupling-arm assembly (RPCA assembly). The power unit is mounted on the framework pivotally at a pivot position that is at least approximately directly beneath the center-of-gravity of the power unit in order to balance the power unit and thereby reduce transmission of linear forces to the first roller.

7 Claims, 11 Drawing Sheets

Fig. 2 - Prior Art

TUBE BENDER

BACKGROUND OF THE INVENTION

1. Technical Field

This invention relates generally to the fields of metal forming and metal-forming tools such as pyramid rollers, tube-bending machines, and the like. It relates more particularly to an electrically powered portable tube bender that eliminates the need for a hand crank without otherwise significantly affecting tube bender operation.

2. Description of Related Art

The term "tube bender" herein refers to a tool used to form a bend in a metal tube or other length of stock. It bends the length of stock under operator control between opposing spaced-apart rollers to form a controlled radius with minimum twist (i.e., minimum distortion in the cross section of the stock as viewed in a plane perpendicular to the axis of elongation). Bending a length of stock that way is sometimes referred to as "air bending" (as opposed to "mandril bending") and it has been in use since at least as far back as the early days of metal-tired wagon wheels. Nowadays, such air bending has found many more uses, even being used for metal railing and other decorative objects.

Some air-bending people perform many tube-bending tasks with a "portable" tube bender. Hawke Industries of Sun City, Calif. manufacturers one such manually powered portable tube bender as its "Gate Pro 3-Inch" model for tubes measuring up to about 3 inches by 3 inches and up to a 0.120-inch wall thickness. It is a portable apparatus in the sense that it weighs less than about one hundred twenty pounds, a weight one or two workers can manage to move about manually. Weighing in typically at about eighty pounds with overall dimensions on the order of about twenty-four inches high, forty-eight inches long, and eight to nine inches wide, the Gate Pro 3-Inch tube bender does not rely on a massive framework to withstand twist-producing asymmetrical forces. It relies, instead, on a carefully designed combination of parts in a symmetrical configuration.

The framework of the Gate Pro 3-Inch tube bender includes two uniformly spaced apart, 0.25-inch thick, steel framework members disposed in plane symmetry on opposite sides of a longitudinally extending vertical reference plane. The two framework members support three rollers on three separate and parallel rotational axes, with the three rollers being rotatably mounted on shafts (axles) that span the two spaced-apart framework members. In operation, the user rotates the uppermost roller (i.e., the centrally disposed main roller) by turning a crank attached to the main roller axle. As the user does so, rotation of the uppermost roller feeds the length of stock longitudinally through the space between the two spaced-apart framework members so that the stock travels intermediate the uppermost roller and the two lower rollers. In conjunction with that operation, the user adjusts the height of the uppermost roller on the framework in order to apply a desired downward force on the stock being bent, a downward force that is opposed upwardly by the two lower rollers. That action results in a bend in the stock having a desired radius that is dependent on roller spacing and the downward force applied by the uppermost roller.

Although such portable tube benders are effective in many respects, manual cranking involves extra physical effort and attention by the user beyond that required to carefully guide the length of stock through the apparatus while adjusting the uppermost roller. Thus, there is room for improvement.

SUMMARY OF THE INVENTION

In view of the foregoing, it is a primary object of the present invention to provide a portable tube bender apparatus that alleviates the concerns outlined above. The present invention achieves this objective predicated on the inventor's recognition of the forces involved and his conception of an electric power source for the uppermost roller that is balanced in a way that results in little, if any, transmission of linear forces to the uppermost roller. To that end, the electric power source is mounted on the base of the tube bender framework pivotally, at an advantageous balance point, while coupling rotational power to the uppermost roller via a linkage component that avoids transmitting significant linear forces. They form what may be called a free-floating power linkage. Thus, the present invention provides an electrically powered portable tube bender that eliminates the need for a hand crank without otherwise significantly affecting tube bender operation To paraphrase some of the more precise language appearing in the claims and further introduce the nomenclature used, an apparatus constructed according to the invention for bending a length of stock includes a portable tube-bending component combined with a power unit. In terms of a first preferred embodiment, the portable tube-bending component includes a framework supporting a complement of three rollers. The framework has a base portion for placement on a work bench or other support structure in a normal operating position of the framework, and the framework includes two spaced-apart frame members extending vertically upward from the base portion when the framework is in the normal operating position. The three rollers are mounted rotatably on three spaced-apart, parallel axles that span the two spaced-apart frame members so that the rollers are disposed intermediate the two frame members. In that configuration, the three rollers function as stock-bending means for bending the length of stock under operator control while the two spaced-apart frame members maintain a desired degree of twist-avoiding symmetry.

A first one of the three rollers (i.e., the uppermost roller) functions as means for feeding the stock horizontally between the two spaced-apart frame members while applying downward force vertically to the length of stock. It is mounted on the framework for rotational movement and linear movement (i.e., vertical movement). Its prior-art counterpart is the roller operated with a hand crank. The other two rollers bear upwardly, and the combination of the upward and downward forces from the three rollers produces the desired bend.

According to a major aspect of the invention, the power unit includes a motor-and-reduction-gear assembly (MARG assembly), for producing rotational output power (preferably from electric input power), and a rotational-power-coupling-arm assembly (RPCA assembly) for coupling rotational power from an output shaft of the MARG assembly to the axle of the first roller. The power unit thereby drives the first roller of the portable tube-bending component without the need for a crank.

The MARG assembly is mounted on the base of the framework pivotally, for pivotal movement about a pivotal axis of the MARG assembly. Preferably, the pivotal axis of the MARG assembly is disposed at least approximately directly beneath the center-of-gravity of the power unit (i.e., the center-of-gravity of the combination of the MARG assembly and the RPCA assembly). The power unit is balanced on the MARG assembly mounting in that sense. As the user moves the first roller vertically, the MARG assembly pivots slightly (e.g., up to about eight to nine degrees or so) to accommodate movement of the RPCA assembly as the RPCA assembly follows vertical movement of the first roller. That action proceeds without significantly affecting balance of the power unit or transmitting significant linear forces to the first roller.

Viewing the power unit as a two-bar linkage, the MARG assembly represents a first bar of the linkage that extends from the pivotal axis of the MARG assembly mounting to the rotational axis of the output shaft, while the RPCA assembly represents a second bar extending from the rotational axis of the output shaft to the rotational axis of the first roller. Pivotal movement of the MARG assembly about the pivotal axis combines with pivotal movement of the RPCA assembly about the rotational axis of the output shaft and the rotational axis of the first roller to achieve what may be called a free-floating transfer of rotational power to the first roller.

Thus, the invention provides a power unit for driving the first roller without introducing significant twist-producing linear forces. The following detailed description and accompanying illustrative drawings make the foregoing and other objects, features, and advantages of the invention more apparent.

DESCRIPTION OF THE PREFERRED EMBODIMENTS

Figure 1:
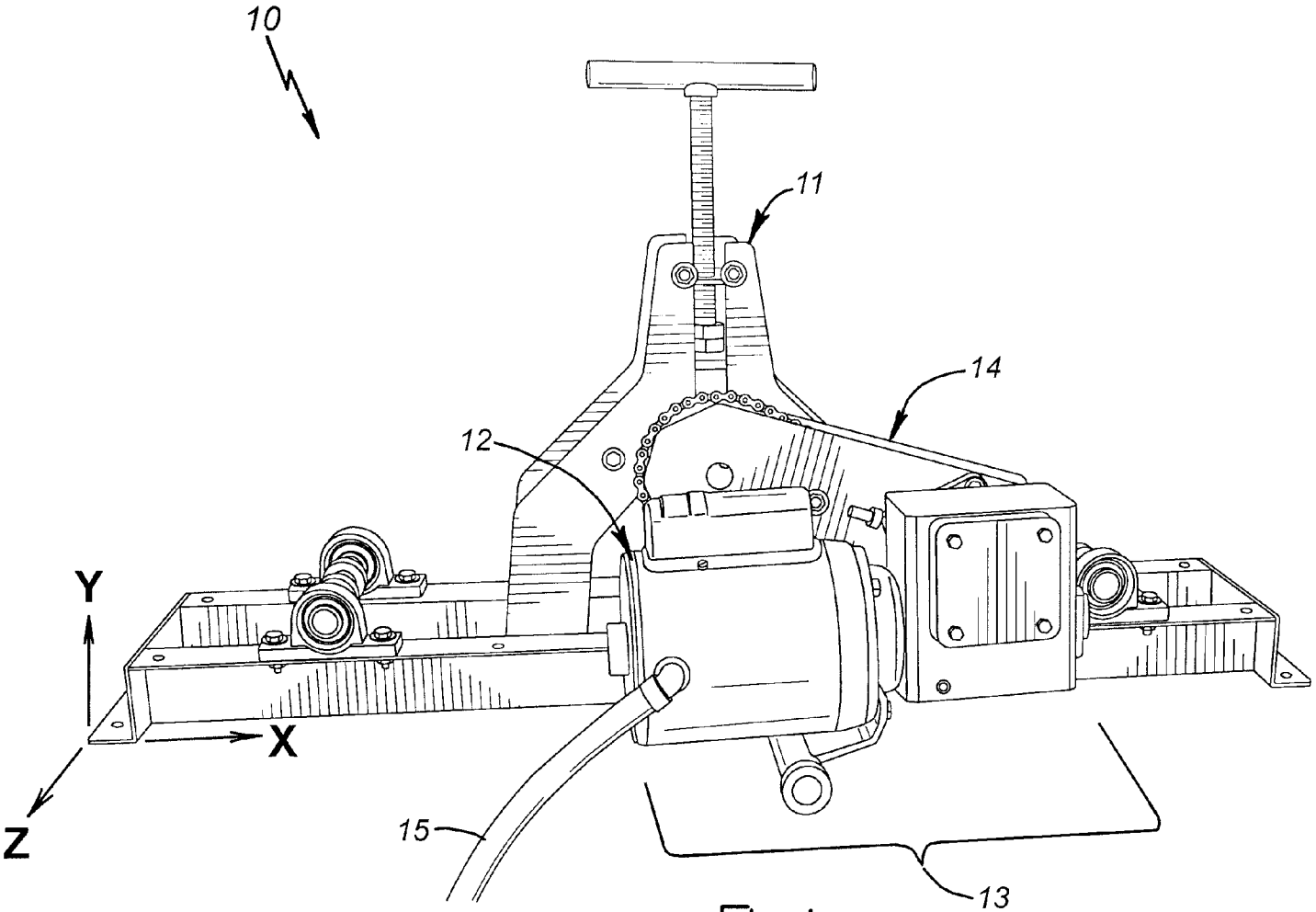
FIG. 1 of the drawings is a perspective view of an electrically powered tube bender apparatus constructed according to the invention, shown in its normal upright operating position, with an XYZ Cartesian coordinate system provided for convenience in describing various spatial orientations.

FIG. 1 of the drawings shows an electrically powered tube bender apparatus 10 constructed according to the invention. It is shown in a normal operating position of the apparatus 10 relative to the horizontal X-Z axis of an XYZ Cartesian coordinate system. Generally, the apparatus 10 includes a portable tube-bending component 11 (i.e., a first component weighing less than approximately one hundred twenty pounds) and a power unit component (i.e., a second component identified as a power unit 12) for providing rotational power to the first component. The power unit 12 includes the combination of a motor-and-reduction-gear assembly 13 that is hereinafter referred to as a "MARG assembly 13," and a rotational-power-coupling-arm assembly 14 that is hereinafter referred to as an "RPCA assembly 14." The MARG assembly 13 has an electric motor and a gearbox that cooperatively produce rotational power at an output shaft of the gearbox, while the RPCA assembly 14 couples the rotational power from the output shaft to a first roller on the component 11. To form a bend with the apparatus 10, the user connects electrical power to the power unit 12 via a power cord 15 and then proceeds to form the bend in a known way without having to operate a crank.

Figure 2:
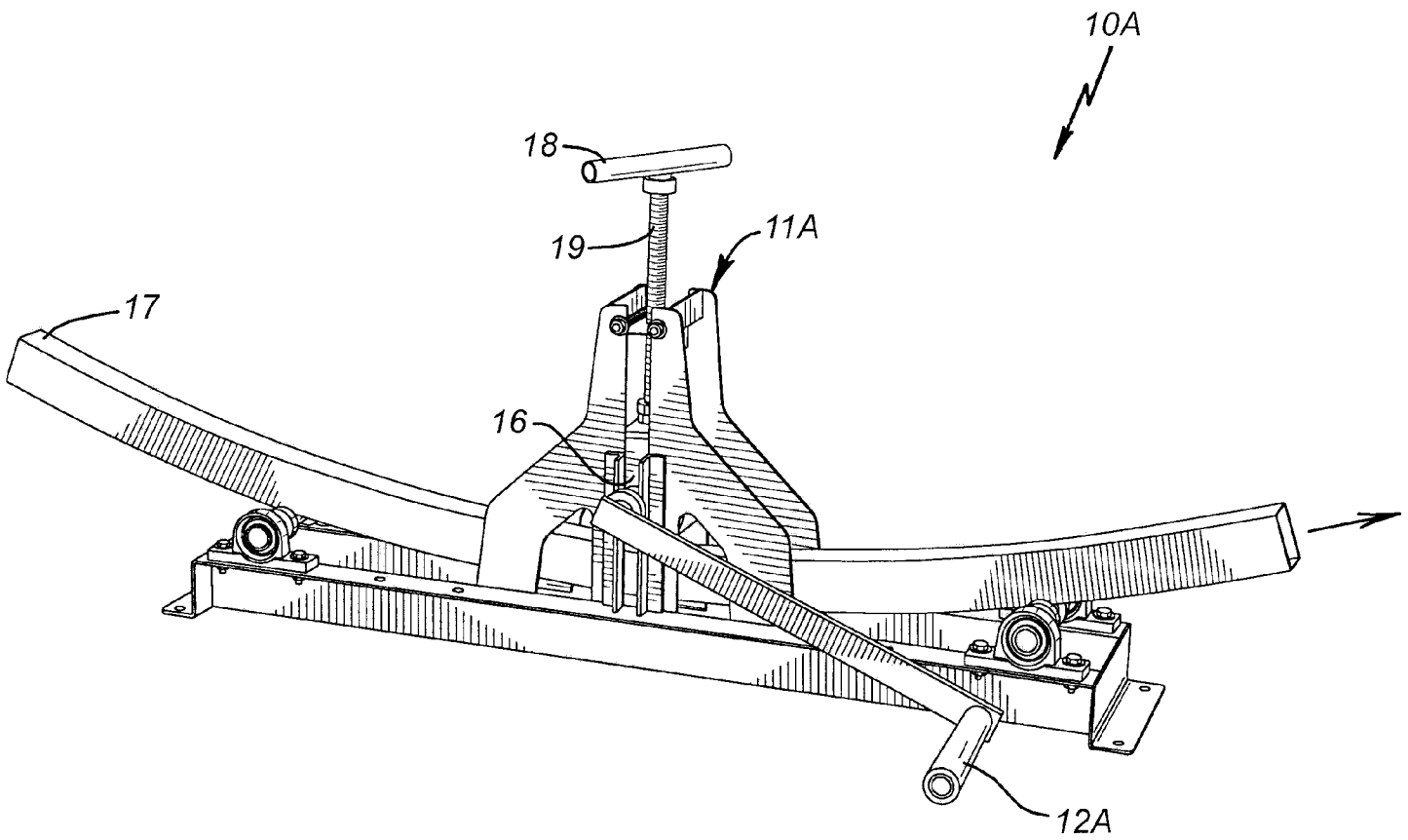
FIG. 2 of the drawings is a perspective view similar to FIG. 1, but of a manually powered tube bender apparatus constructed according to the prior art.

By way of comparison, a crank-outfitted tube bender 10A is shown in FIG. 2. The tube bender 10A is a prior art apparatus that includes a portable tube-bending component 11A on which is mounted a crank 12A. Manually operating the crank 12A rotates a stock-feeding roller 16 that feeds a length of stock 17 longitudinally through the tube-bending component 11A to form a desired bend. In conjunction with movement of the length of stock 17 through the tube-bending component 11A, the user manipulates a handle 18 on a roller-advancing threaded shaft 19 in order to advance the stock-feeding first roller 16 vertically as required to achieve the desired bend. Thus, the user must expend extra physical effort and attention operating the crank 12A, effort and attention beyond that otherwise required to carefully guide the length of stock 17 and manipulate the handle 18.

Figure 3:
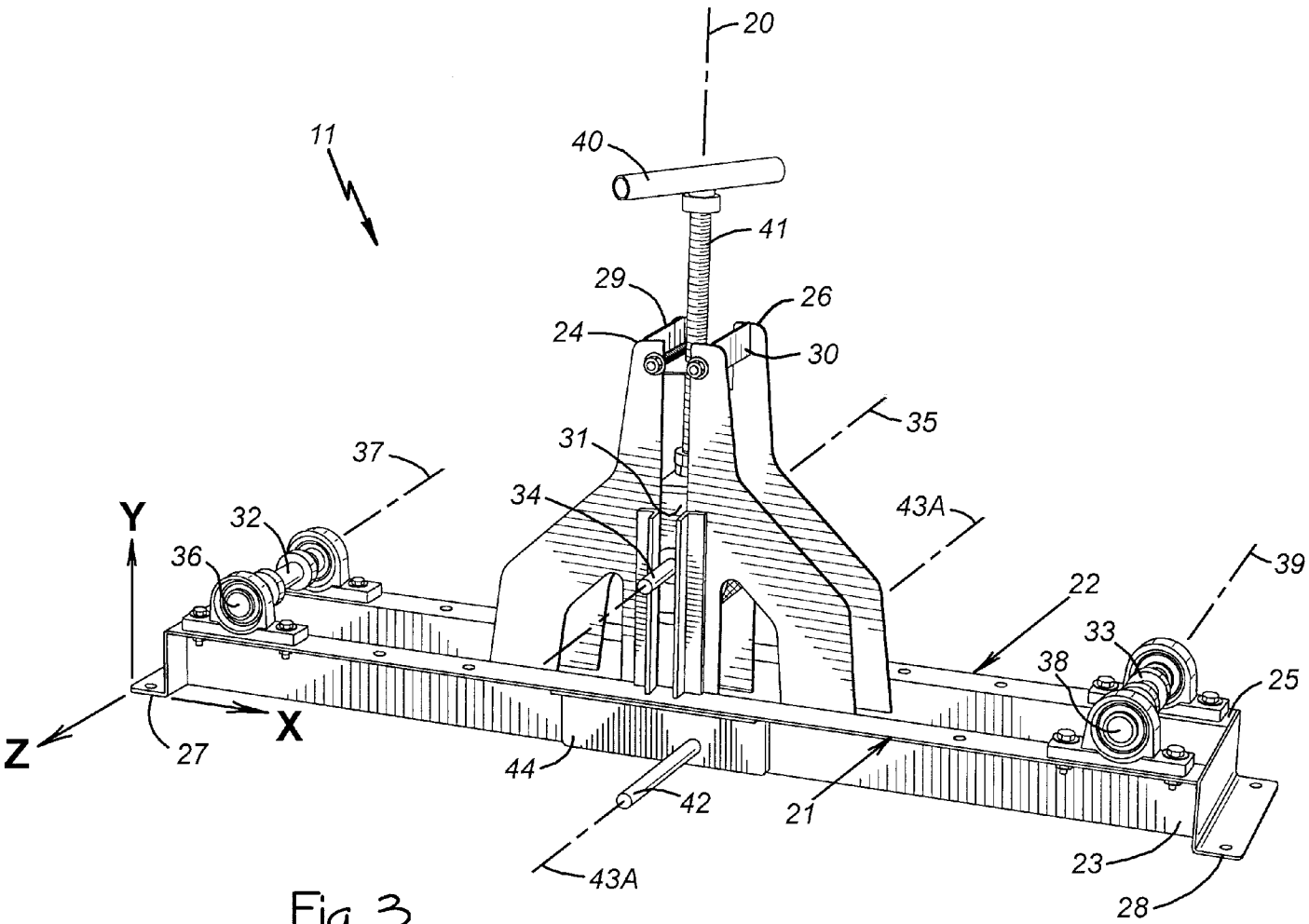
FIG. 3 of the drawings is a perspective view of the electrically powered tube bender apparatus, shown with the power unit removed for illustrative purposes.

Further details of the portable tube-bending first component 11 are shown in shown in FIG. 3. The first component 11 may be similar in many respects to an existing portable tube bender, such as, for example, the "Gate Pro 3-Inch" model mentioned earlier, and various other models, that are available from Hawke Industries of Sun City, Calif. Similar to the Gate Pro 3-Inch model, for example, the first component 11 includes a framework fabricated from 0.25-inch thick steel stock in plane symmetry relative to a vertically oriented longitudinally extending plane that contains a vertically extending axis 20. That plane is disposed parallel to the X-Y axis of the illustrated XYZ Cartesian coordinate system; it is identified in and will be referred to later on in this description with reference to FIG. 5.

With further regard to FIG. 3, it shows that the framework of the first component 11 includes spaced-apart first and second frame members 21 and 22. The first frame member 21 includes a longitudinally extending first frame member part 23 (e.g., a 0.25-inch thick piece of 2-inch by 3-inch angle iron) and an upstanding first frame member part 24 (e.g., a 0.25-inch thick steel plate formed to the illustrated shape). They are welded, bolted, or otherwise rigidly connected together in the configuration illustrated. Similarly, the second frame member 22 includes a longitudinally extending second frame member part 25 and an upstanding second frame member 26 that are welded, bolted, or otherwise rigidly connected together. First and second end pieces 27 and 28 (e.g., 0.25-inch thick steel angle-iron pieces measuring about 8⅜ inches long) are welded, bolted, or otherwise rigidly connected to opposite ends of the parts 23 and 25, while first and second spacers 29 and 30 are welded, bolted, or otherwise rigidly connected to the upper ends of the parts 24 and 26. As such, the framework of the first component 11 is held rigidly in the illustrated configuration.

Functionally, the framework of the first component 11 serves to support three stock-bending rollers 31, 32, and 33. The three rollers 31, 32, and 33 are mounted on the framework in positions intermediate the first and second framework members 21 and 22. The first roller 31 of the three is mounted on a first roller axle 34 for rotation about a first roller rotational axis 35 and for vertical movement along the vertical axis 20. The second roller 32 is mounted on a second roller axle 36 for rotation about a second roller rotational axis 37, and the third roller 33 is mounted on a third roller axle 38 for rotation about a third roller rotational axis 39. In operation, the user rotates the first roller 31 by supplying rotational power to the first roller axle 34. That is done in conjunction with adjustment of the height of the first roller 31 by turning a handle 40 on a threaded shaft 41. In other words, the portable tube-bending first component 11 includes a framework for placement on a support structure in a normal operating position of the framework, along with a first roller 31 mounted on the framework for rotatable movement about a first roller rotational axis 35 and for linear movement along a vertical axis 20 perpendicular to the first roller axis 35 (i.e., it extends vertically when the framework is in the normal operating position). The power unit 12 is coupled to the axle 34 of the first roller 31 in order to couple rotational power to the first roller 31, and the power unit 12 is connected to the framework pivotally in order to accommodate vertical movement of the first roller 31.

Rotational power is supplied to the first roller axle 34 by the power unit 12 (the second component 12 mentioned earlier). The power unit 12 is mounted on the first component 11 using a mounting shaft 42 (e.g., a one-inch diameter steel shaft that functions as a first pivotal mounting). Mounted that way, the power unit 12 is free to pivot about a pivotal axis 43A (i.e., the central axis of elongation of the shaft 42) as is described subsequently. The shaft 42 is welded or otherwise rigidly connected to a steel plate 44 (e.g., a 2.75-inch by 8.5-inch by 0.25-inch thick steel plate), and the steel plate 44 is welded, bolted, or otherwise rigidly mounted on the longitudinally extending first frame member part 23. For symmetry, one embodiment (not separately illustrated) also includes a steel plate on a counterpart of the longitudinally extending second frame member part 25, so that both longitudinally extending frame member parts respond the same under load.

Figure 4:
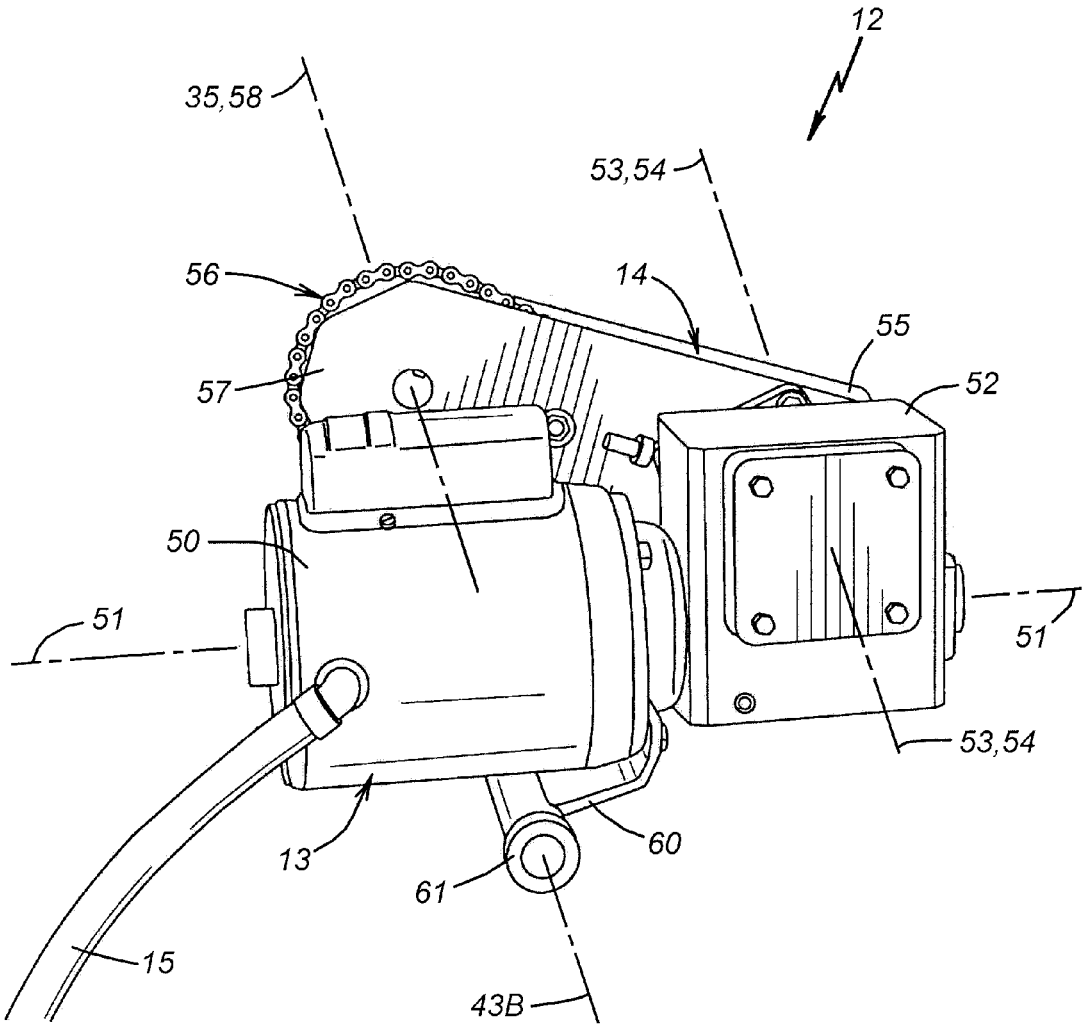
FIG. 4 of the drawings is an enlarged perspective view of just the power unit.

FIG. 4 is an enlarged perspective view of the power unit 12. It consists of the MARG assembly 13 and the RPCA assembly 14. The MARG assembly 12 includes an electric motor 50 that produces rotational power centered on a motor rotational axis 51. The electric motor 50 is coupled to a gearbox 52 that outputs the rotational power from the electric motor 50 to an output shaft of the gearbox 52 at a reduced rotational rate centered on a gearbox rotational axis 53 (e.g., a 70-to-1 reduction ratio). With the MARG assembly operatively connected to the RPCA assembly 14, the gearbox rotational axis 53 is aligned with (i.e., is coincident with) a first rotational axis 54 on a first end portion 55 of the RPCA assembly 14. It is operatively connected or mounted in the sense that it is connected or mounted so that it operates and functions as herein suggested and/or described in order to help couple rotational power from the electric motor 50 to the RPCA assembly 14. So assembled, the MARG assembly 13 supplies rotational power to the first end portion 55 of the RPCA assembly 14, while a two-sprocket roller chain drive assembly 56 (e.g., with a two-to-one reduction ratio) couples that rotational power to a second end portion 57 of the RPCA assembly 14. The roller chain drive assembly utilizes a well-known type of roller chain extending between two toothed wheels (i.e., sprockets) as described later on with reference to FIG. 11.

With the power unit 12 operatively mounted on the shaft 42 of the portable tube-bender first component 11, for pivotal movement about the pivotal axis 43A, a pivotal axis 43B of the MARG assembly 13 is aligned with (i.e, coincident with) the pivotal axis 43A of the shaft 42. In addition, the second end portion 57 of the RPCA assembly 14 is operatively mounted on the axle 34 of the first roller 31 (FIG. 3) so that a second rotational axis 58 on the second end portion 57 of the RPCA assembly 14 is aligned with (i.e., is coincident with) the first roller rotational axis 35. It is operatively connected or mounted in the sense that it is connected or mounted so that it operates and functions as herein suggested and/or described in order to help couple rotational power from the RPCA assembly 14 to the first roller 14. So arranged, the power unit 12 supplies rotational power to the first roller 31 about the axes 35 and 58 while being free to pivot about the pivotal axes 43A and 43B in order to accommodate vertical movement of the first roller 31.

Any of various known electric motors and reduction gearbox components may be used to implement a power unit according to the present invention. The illustrated power unit 12 includes a ½-horsepower, 1760 RPM, 110-volt motor 50 and mating reduction gearbox 52 that are commercially available. A bracket 60 welded, or otherwise suitably attached to the electric motor 50, supports a steel tube 61 that slides over the shaft 42 on the portable tube-bender first component 11 as a pivotal mounting for the MARG assembly 13 (i.e., a second pivotal mounting 61 that mates with the first pivotal mounting, the shaft 42 on the framework 11). For that purpose, the tube 61 has a cylindrical inside diameter (ID) just slightly larger than the one-inch outside diameter (OD) of the shaft 42. Of course, bearings may be used as part of the pivotal mounting. Apart from those details, the center-of-gravity of the power unit 12 and the position of the pivotal axis 43B relative thereto are of major significance as will be discussed subsequently, along with the straight-line distance between the pivotal axis 43B of the MARG assembly pivotal mounting and the rotation axis 53 of the gearbox 52 output shaft 62 identified in FIG. 5 (e.g., about 9.5 inches for the illustrated MARG assembly 13), and the straight-line distance between the first and second rotational axes 54 and 58 of the RPCA assembly 14 (e.g., about 8¾ inches for the illustrated RPCA assembly 14).

Figure 5:
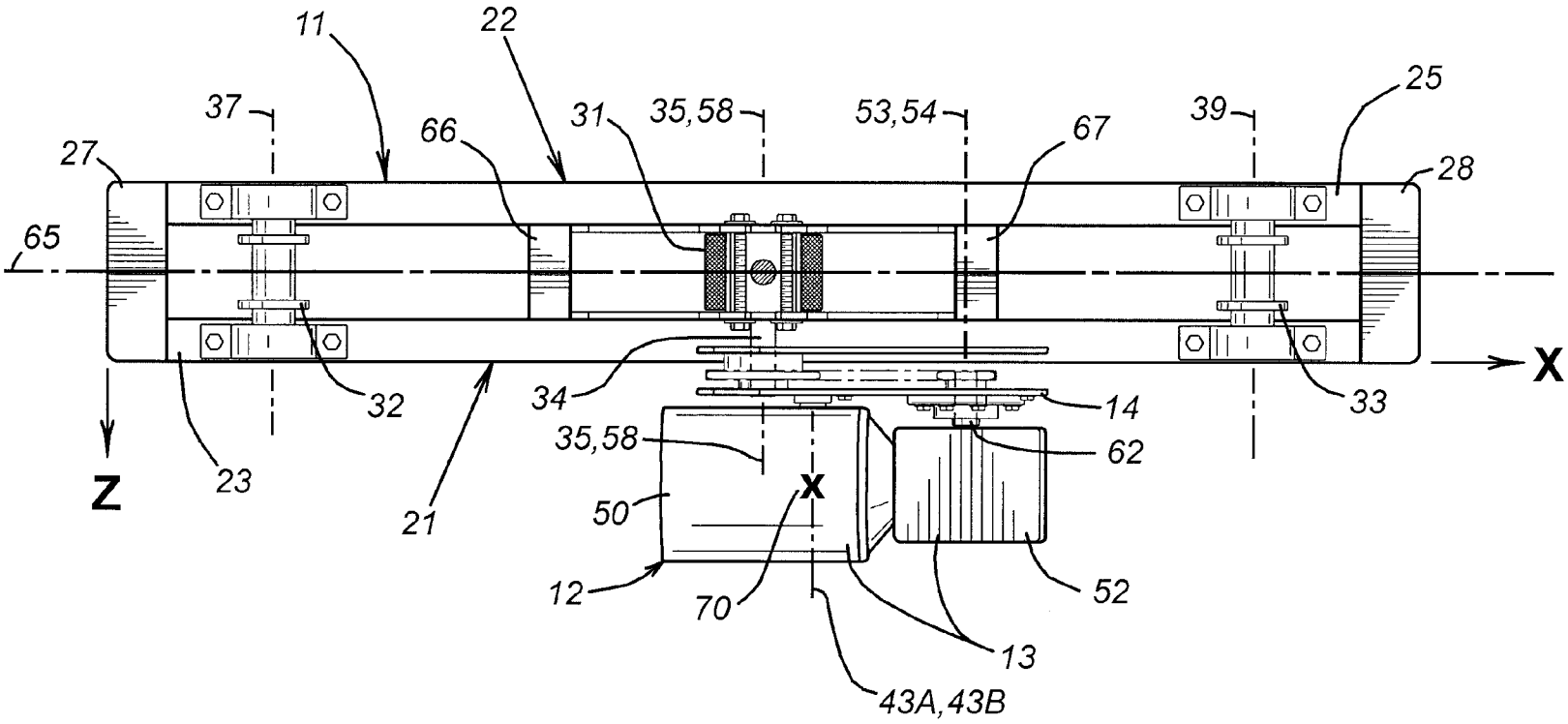
FIG. 5 is a top plan view of the apparatus as viewed in a horizontal plane located just below the handle member on the threaded vertical adjustment shaft.

Axis orientations are further illustrated in the top plan view of FIG. 5 relative to a vertically oriented bisecting plane 65 about which the tube-bending first component 11 is disposed in plane symmetry. The plane 65 is depicted by a phantom line in FIG. 5. Spacers 66 and 67 (e.g., 0.25-inch thick steel pieces) are welded or otherwise rigidly attached to the longitudinally extending first and second frame member parts 23 and 25 where they cooperate with the end pieces 27 and 28 to hold the parts 23 and 25 in the illustrated orientation (e.g., spaced apart laterally by about 4⅜ inches). The rotational axes 35, 37, and 39 of the first, second, and third rollers 31, 32, and 33 extend perpendicular to the plane 65, as do the rotational axis 54 and 58 of the RPCA assembly 14, the rotational axis 53 of output shaft 62 of the gearbox 52, and the pivotal axes 43A and 43B of the first and second pivotal mountings on the framework of the first component 11 and on the MARG assembly 13.

To achieve a free-floating linkage of rotational power to the axle 34 of the first roller 31, the pivotal axis 43B of the MARG assembly is disposed directly beneath a center-of-gravity (i.e., COG 70) of the power unit 12 (i.e., at least approximately directly beneath it) when the power unit 12 is operatively connected to the first component 11 (i.e., mounted pivotally on the mounting shaft 42. In other words, the power unit 12 and the mounting shaft 42 are arranged so that COG 70 lies in a vertical plane that contains the pivotal axes 43A and 43B (or at least closely thereto). With the power unit 12 so mounted, little if any linear force is transferred from the power unit 12 to the axle 34 of the first roller 31. Primarily, only rotational power is transferred. The COG 70 for the power unit 12 is identified in FIG. 5 by a bold letter "X" above the pivotal axes 43A and 43B. Depending on the design of any particular power unit, the location of the center-of-gravity may vary from that identified for the power unit 12. Whatever the location of the center-of-gravity may be for any particular power unit design, however, the second pivotal mounting 61 on the MARG assembly 13 and the first pivotal mounting 42 on the framework of the first component 11 (i.e., the shaft 42) are located accordingly so that the power unit is balanced.

Figure 6:
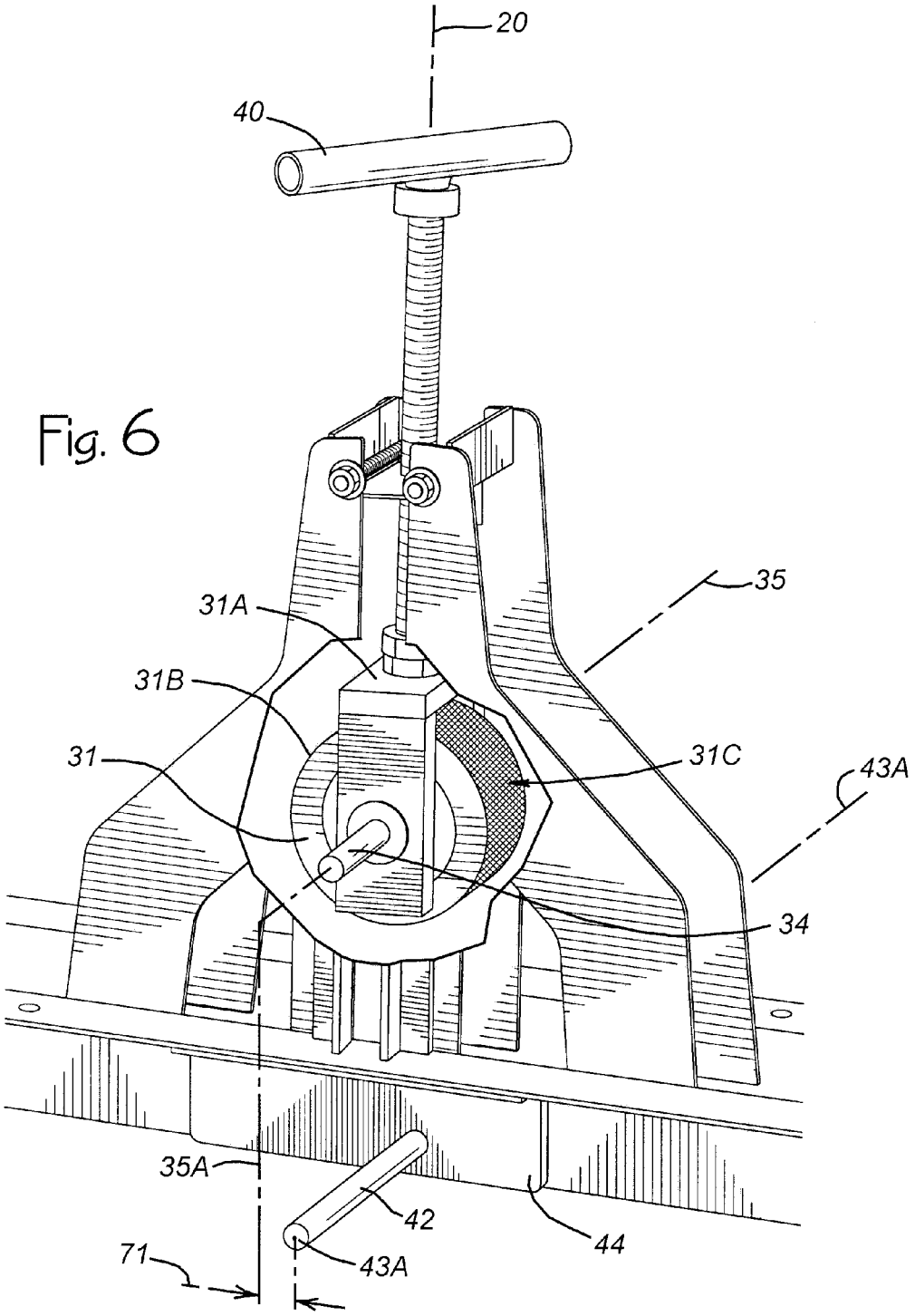
FIG. 6 is an enlarged perspective view of a central portion of the apparatus, with portions broken away to expose the knurled pattern on the first roller.

FIG. 6 is an enlarged portion of the portable tube-bending first component 11. It shows the location of the pivotal axis 43A of the mounting shaft 42 for the illustrated power unit 12 to be spaced horizontally about two inches from a vertical plane 35A containing the rotational axis 35 of the first roller 31 (and containing the vertical axis 20) and about ¾ inches above the Y-Z plane of the XYZ Cartesian coordinate system indicated in FIGS. 1 and 3. The horizontal dimension is indicated as a dimension 71 in FIGS. 6 and 7, it is measured perpendicular to the vertical plane 35A. That placement of the pivotal axis 43A takes into consideration the straight-line distance between the pivotal axis 43B and the rotation axis 53 of the gearbox 52 output shaft (i.e., the shaft 62 in FIG. 5), together with the straight-line distance between the first and second rotational axes 54 and 58 of the RPCA assembly 14. Mounting location is a function of those straight-line distances. For the illustrated power unit 12, those distances are, for example, approximately 9.25 inches between axes 43B and 53 and approximately 8.75 inches between axes 54 and 58.

FIG. 6 also shows a vertically adjustable carriage assembly 31A that rotatable supports the first roller 31. Turning the handle 40 causes the first roller 31 to move vertically along the vertical axis 20. Thus, the apparatus 10 includes height-adjusting means for enabling a user to manually move the first roller 31 linearly between user-desired positions of the first roller in order to bear downwardly against the stock while the second and third rollers 32 and 33 bear upwardly against the stock in order to thereby produce a desired bending action. The balanced power unit 12 pivots to accommodate that vertical movement. In addition, the first roller 31 is seen to have an outer surface 31B that includes a knurled pattern 31C. The knurled pattern 31C enhances force distribution and transfer from the first roller 31 to a length of stock being advanced longitudinally by the first roller 31 during a tube-bending operation. Stated another way, the first roller 31 includes knurled means for enhancing an even transfer of stock-feeding force to the stock as the first roller 31 rotates, said knurled means including a stock-facing surface 31B of the first roller 31 and a knurled pattern 31C on the stock-facing surface 31B.

Figure 7:
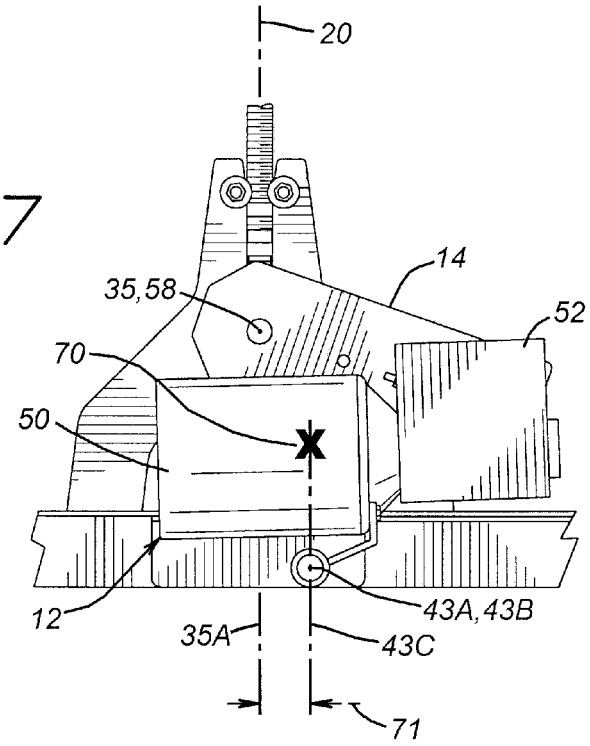
FIG. 7 is a front elevation view of a portion of the apparatus showing pivotal mounting details of the MARG assembly.
Figure 8:
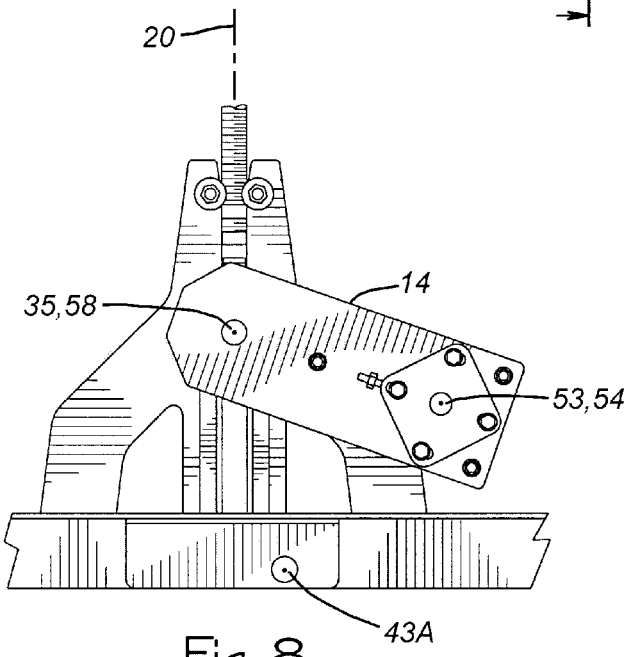
FIG. 8 is a front elevation similar to FIG. 7, but with the power unit removed for illustrative purposes.
Figure 9:
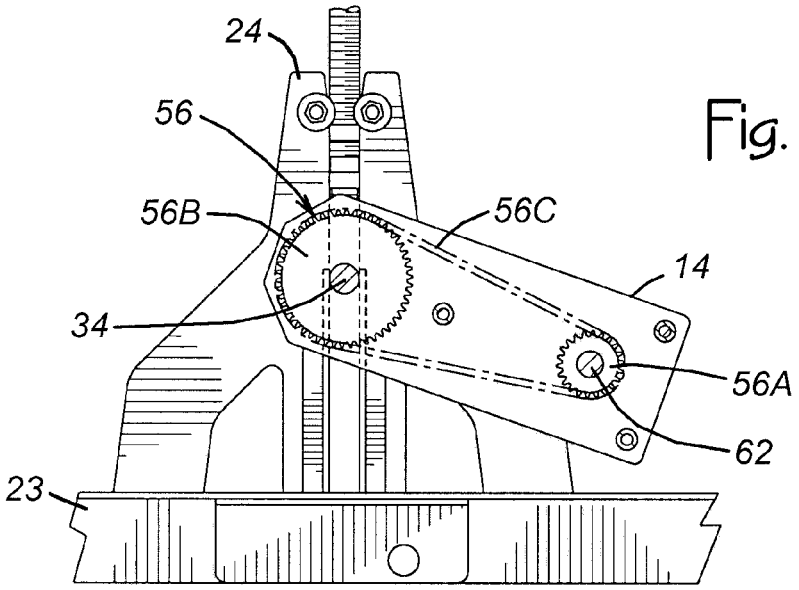
FIG. 9 is a front elevation view similar to FIG. 8, but with the internal parts of the RPCA assembly shown.
Figure 10:
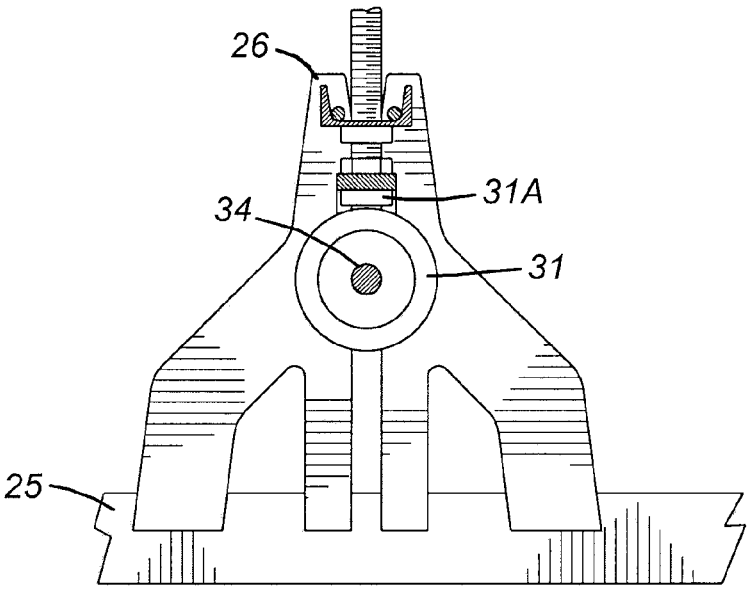
FIG. 10 is an elevation view of a portion of the second frame member as viewed in a vertically oriented bisecting plane.

FIGS. 7, 8, 9, and 10 show various other details of construction In FIG. 7, the two-inch dimension 71 for the illustrated embodiment is shown between a vertical plane 43C and a vertical plane 35A. The vertical plane 43C contains the pivotal axes 43A and 43B, along with the COG 70 (a bold letter "X"), while the vertical plane 35A (oriented parallel to the Y-Z plane of the XYZ Cartesian coordinate system) contains the vertical axis 20. The two-inch dimension 71 is the dimension that results from the particular size and COG placement of the power unit 12. FIG. 8 is similar to FIG. 7, except that the power unit 12 is omitted to expose the RPCA assembly 14. FIG. 9 shows that the roller chain drive assembly 56 includes a first sprocket 56A on the output shaft 62 of the MARG assembly, a second sprocket 56B on the axle 34 of the first roller, and a roller chain 56C in place over the two sprockets 56A and 56B in order to couple rotational power from the output shaft 62 to the axle 34. FIG. 10 provides an elevation view of the upstanding second frame member 26 that is welded, bolted, or otherwise rigidly connected to the second longitudinally extending second frame member part 25.

Figure 11:
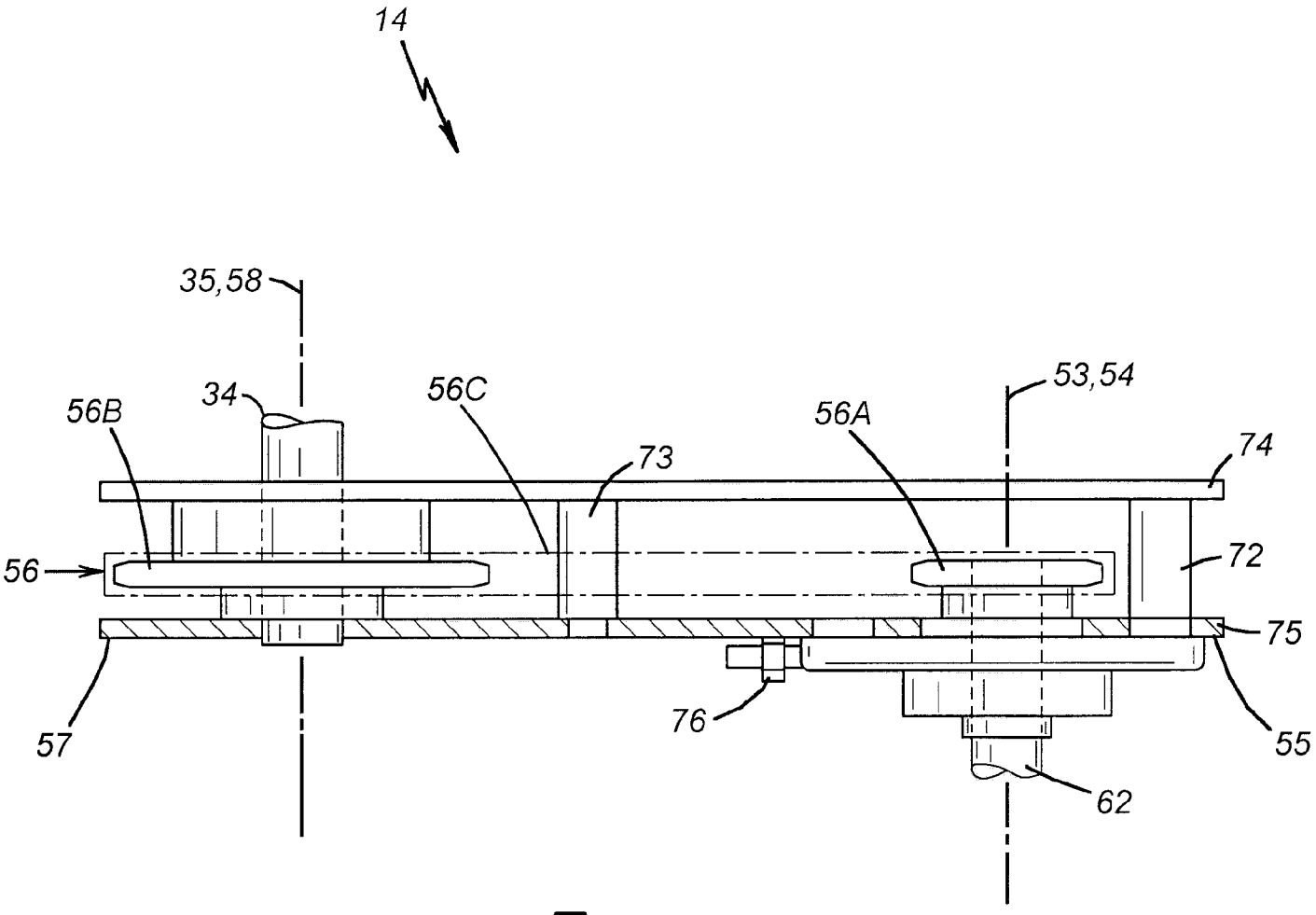
FIG. 11 is an enlarged top plan view of the RPCA assembly.

FIG. 11 is an enlarged plan view of just the RPCA assembly 14. Rigid spacers 72 and 73 are welded, bolted, or otherwise attached to two steel side plates 74 and 75 (e.g., 0.25-inch thick by about fourteen inches long) in order to help hold the side plates 74 and 75 in spaced-apart relationship as a support for the first and second sprockets 56A and 56B (e.g., spaced apart by about 1⅜ inches). The first sprocket 56A (e.g., thirteen teeth) is mounted between the first and second side plates 74 and 75 for rotation about the coincident axes 53 and 54. Similarly, the second sprocket 56B (e.g., twenty-six teeth) is mounted between the first and side second plates 74 and 75 for rotation about the coincident axes 35 and 58. The roller chain 56C encircles the sprockets 56A and 56B, while a chain-tensioning assembly 76 enables adjustment of the tension of the roller chain 56C. In the case of thirteen teeth on the first sprocket 56A and twenty-six teeth on the second sprocket 56B, the resulting two-to-one reduction ratio if the RPCA assembly 14 combines with the seventy-to-one reduction ratio of the gearbox 52 on the MARG assembly 13 to provide an overall 140-to-1 reduction in rotational speed of the electric motor 50.

Figure 12:
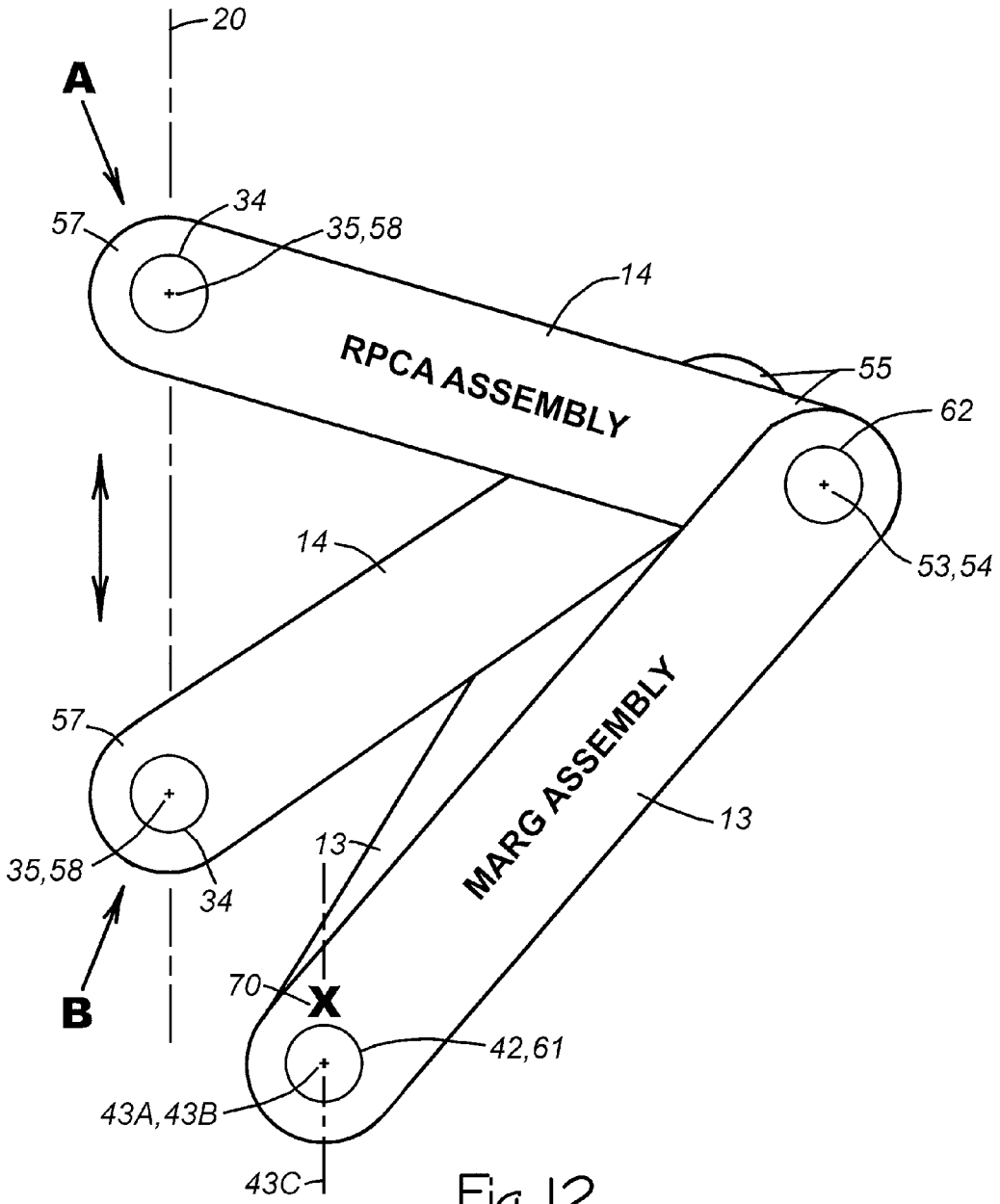
FIG. 12 is a diagrammatic view of the free-floating linkage accomplished by the combination of the MARG assembly and the RPCA assembly, showing placement of those two assemblies for both an uppermost position and a lowermost position of the main roller.

FIG. 12 is a simplified linkage diagram showing the positions of the MARG assembly 13 and the RPCA assembly 14 for uppermost and lowermost vertical positions of the first roller axle 34. The uppermost position of the first roller axle 34 is identified by a bold letter "A," and the lowermost position is identified by a bold letter "B." The vertical direction of travel (e.g., an overall vertical distance of about 6.5 inches) is identified by a double-headed arrow near the vertical axis 20. In this linkage diagram, the MARG assembly 13 functions as a first link (or first "bar") and the RPCA assembly 14 functions as a second link (or second "bar"). As the user moves the first roller axle 34 from the uppermost position to the lowermost position, the RPCA assembly 14 follows the axle 34 while the MARG assembly 13 accommodates that movement by pivoting about the pivotal axis 43 through an arc of about 8.5 degrees. Those movements occur as rotational power is coupled to the axle 34, with little, if any, interference by the transfer of linear forces from the power unit 12 to the axle 34. The COG does move slightly relative to the pivotal axes 43A and 43B as the power unit pivots, and so, preferably, the pivotal axes are located beneath the COG when the first roller is midway between the uppermost position A and the lowermost position B. That way, there is only a slight power unit imbalance (i.e., 4.25 degrees of imbalance) on either side of that midway position.

Figure 13:
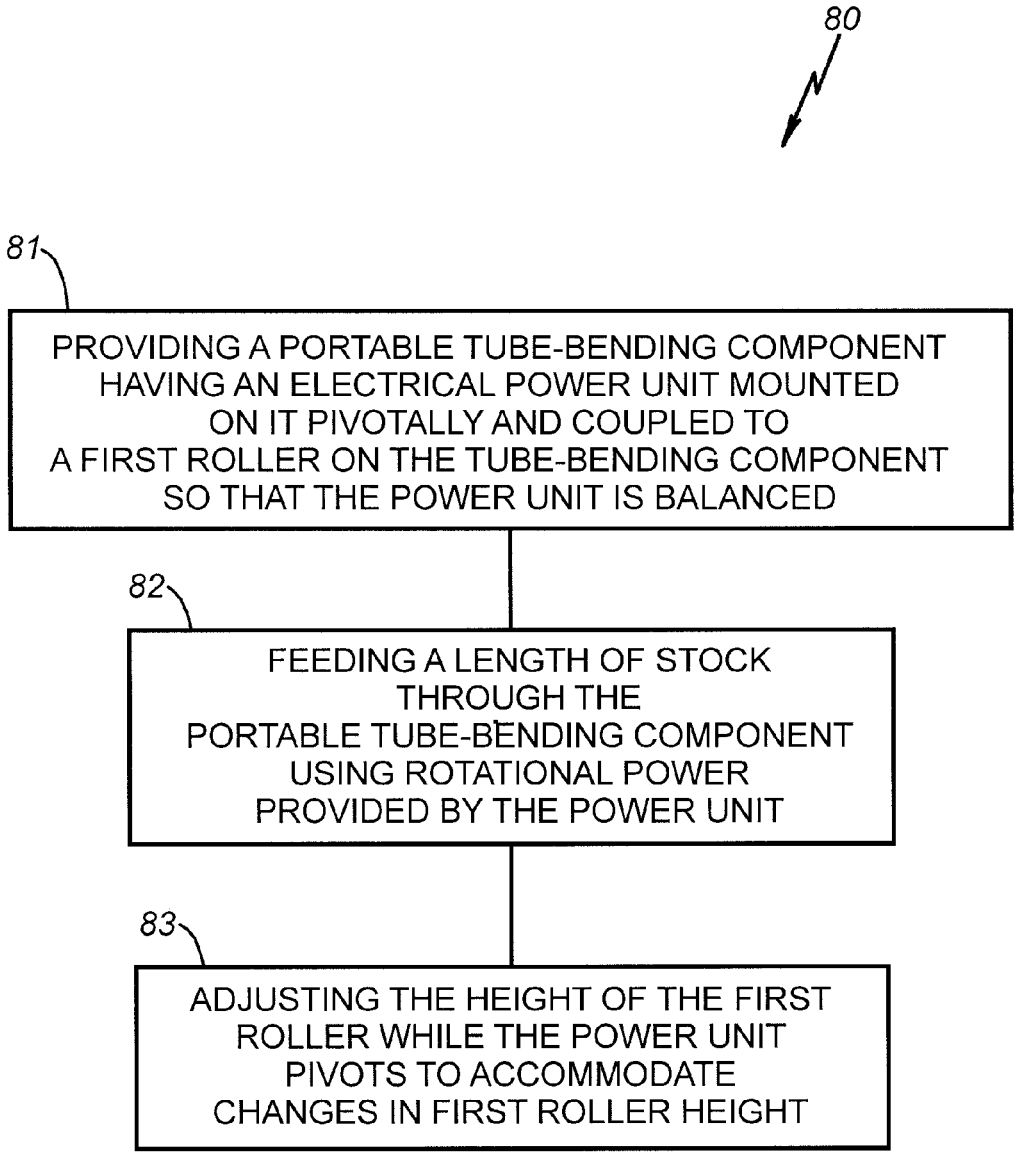
FIG. 13 is a block diagram of a method for operating a portable tube-bending component according to methodology of the instant invention.

Based upon the foregoing and subsequent descriptions taken with the drawings and the claims, a person having ordinary skill in the art can readily implement a portable tube-bending apparatus according to the present invention. FIG. 13 recaps the methodology of the present invention as a method for operating a portable-tube-bending component having a framework and a first roller mounted on the framework for rotational movement and linear movement. The method is illustrated by a block diagram 80. It includes the steps indicated by a block 81 of providing a power unit component having a MARG assembly for producing rotational power at an output shaft of the MARG assembly and an RPCA assembly for coupling the output shaft to the first roller. Those assemblies are such that the MARG assembly is mounted pivotally on the framework beneath the center-of-gravity of the power unit. In addition, a first end of the RPCA assembly is coupled pivotally to the output shaft, and a second end of the RPCA assembly is coupled to the first roller. The method then proceeds as indicated by blocks 82 and 83 by feeding a length of stock through the portable-tube-bending component using the rotational power provided by the power unit, adjusting the height of the first roller while the power unit pivots to accommodate changes in first roller height.

Thus, the invention provides a tube bender having an electric power unit instead of a manually operated crank, doing so with a free-floating balance power unit that avoids introducing significant twist-producing forces. Although an exemplary embodiment has been shown and described, one of ordinary skill in the art may make many changes, modifications, and substitutions without necessarily departing from the spirit and scope of the invention. The illustrative dimensions provided may vary significantly depending on the precise layout. As for the specific terminology used to describe the exemplary embodiment, it is not intended to limit the invention; each specific term is intended to include all technical equivalents that operate in a similar manner to accomplish a similar purpose or function. For example, the terms "horizontal," "horizontally," "vertical," "vertically," "parallel," "perpendicular," and the like herein state orientations, and those terms herein include approximations of the stated orientations.

What is claimed is:

1. An apparatus for bending a length of stock, the apparatus comprising:

a portable tube-bending component that functions as stock-bending means for bending the length of stock under operator control; and a power unit that functions as means for providing rotational power to the first component;

wherein the portable tube-bending component includes (a) a framework for placement on a horizontally oriented support structure in a normal operating position of the framework, (b) a first roller having a first roller axle mounted on the framework for rotational movement about a horizontally oriented first roller rotational axis and for vertical movement perpendicular to the first roller rotational axis between an uppermost position of the first roller and a lowermost position of the first roller, and (c) a first pivotal mounting structure on the framework on which to mount the power unit for pivotal movement about a first pivot axis that is parallel to the first roller rotational axles;

wherein the power unit includes a MARG assembly for producing rotational power, said MARG assembly having an electric motor and a gearbox that cooperatively produce rotational power at an output shaft of the gearbox;

wherein the power unit includes an RPCA assembly for coupling the rotational power from the output shaft of the gearbox to the first roller axle, said RPCA assembly having a first sprocket connected to the output shaft of the gearbox, a second sprocket for connection to the first roller axle, and a roller chain coupling the first sprocket to the second sprocket;

wherein the MARG assembly includes a second pivotal mounting structure that mates with the first pivotal mounting structure on the framework component; and wherein the second pivotal mounting structure has a second pivotal axis such that when the framework of the portable tube-bending component is in the normal operating position, with the second pivotal mounting structure of the MARG assembly mounted on the first pivotal mounting structure on the framework and the second sprocket of the RPCA assembly operatively connected to the first roller axle, the second pivotal axis is located at least approximately directly beneath a center-of-gravity of the power unit.

2. An apparatus as recited in claim 1, wherein the first roller includes knurled means for enhancing an even transfer of stock-feeding force to the stock as the first roller rotates, said knurled means including a stock-facing surface of the first roller and a knurled pattern on the stock-facing surface.

3. An apparatus as recited in claim 1, further comprising:

a second roller mounted on the framework for rotational movement about a second roller rotational axis that is parallel to the first roller rotational axis;

a third roller mounted on the framework for rotational movement about a third roller rotational axis that is parallel to the first roller rotational axis; and the apparatus includes height-adjusting means for enabling a user to manually move the first roller linearly between user-desired positions of the first roller in order to bear downwardly against the stock while the second and third rollers bear upwardly against the stock in order to thereby produce a desired bending action.

4. An apparatus as recited in claim 1, wherein the RPCA assembly includes a first sprocket connected to the output shaft, a second sprocket connected to the first roller, and a roller chain coupling the first sprocket to the second sprocket.

5. A power unit for providing rotational power to a portable tube-bending component having (a) a framework for placement on a horizontally oriented support structure in a normal operating position of the framework, (b) a first roller having a first roller axle mounted on the framework for rotational movement about a horizontally oriented first roller rotational axis and for vertical movement perpendicular to the first roller rotational axis between an uppermost position of the first roller and a lowermost position of the first roller, and (c) a first pivotal mounting structure on the framework on which to mount the power unit for pivotal movement about a first pivot axis that is parallel to the first roller rotational axles, the power unit comprising:

a MARG assembly for producing rotational power, said MARG assembly having an electric motor and a gearbox that cooperatively produce rotational power at an output shaft of the gearbox; and an RPCA assembly for coupling the rotational power from the output shaft of the gearbox to the first roller axle;

wherein the MARG assembly includes a second pivotal mounting structure that mates with the first pivotal mounting structure on the framework such that with the second pivotal mounting structure of the MARG assembly mounted on the first pivotal mounting structure and the RPCA assembly operatively connected to the first roller, the MARG assembly pivots about the first pivotal axis as the RPCA assembly follows vertical movement of the first roller.

6. An apparatus as recited in claim 5, wherein the second pivotal mounting structure has a second pivotal axis such that when the framework of the portable tube-bending component is in the normal operating position, with the second pivotal mounting structure of the MARG assembly mounted on the first pivotal mounting structure on the framework and the RPCA assembly operatively connected to the first roller axle, the second pivotal axis is coincident with the first pivotal axis and located at least approximately directly beneath a center-of-gravity of the power unit.

7. An apparatus as recited in claim 5, wherein the RPCA assembly includes a first sprocket connected to the output shaft of the gearbox, a second sprocket for connection to the first roller axle, and a roller chain coupling the first sprocket to the second sprocket.

* * * * *